US012203286B2

(12) United States Patent
Fisher et al.

(10) Patent No.: US 12,203,286 B2
(45) Date of Patent: Jan. 21, 2025

(54) SPA POOL COVER LIFTER, AND A SPA POOL INCLUDING A SPA POOL COVER LIFTER

(71) Applicant: Vortex Leisure Pty Ltd, Newcastle West (AU)

(72) Inventors: Adam Fisher, Marks Point (AU); Stephen Louat, Edgeworth (AU)

(73) Assignee: VORTEX LEISURE PTY LTD, Newcastle West (AU)

( * ) Notice: Subject to any disclaimer, the term of this patent is extended or adjusted under 35 U.S.C. 154(b) by 0 days.

(21) Appl. No.: 17/904,362

(22) PCT Filed: Jul. 9, 2021

(86) PCT No.: PCT/AU2021/050733
§ 371 (c)(1),
(2) Date: Aug. 16, 2022

(87) PCT Pub. No.: WO2022/011413
PCT Pub. Date: Jan. 20, 2022

(65) Prior Publication Data

US 2023/0131973 A1 Apr. 27, 2023

(30) Foreign Application Priority Data

Jul. 16, 2020 (AU) ..... 2020902460

(51) Int. Cl.
*E04H 4/08* (2006.01)

(52) U.S. Cl.
CPC ..... *E04H 4/084* (2013.01); *E04H 4/082* (2013.01)

(58) Field of Classification Search
CPC ..... B65D 2251/1083; B65D 2590/00; B65D 2590/0041; B65D 2590/0058;
(Continued)

(56) References Cited

U.S. PATENT DOCUMENTS 4,853,985 A 8/1989 Perry
5,131,102 A 7/1992 Salley et al.
(Continued)

FOREIGN PATENT DOCUMENTS

AT 513983 * 9/2014 ..... E04H 4/084
CA 2432833 C 6/2006
(Continued)

OTHER PUBLICATIONS

International Search Report and Written Opinion of PCT/AU2021/050733 Dated Aug. 13, 2021 in 8 pages.
(Continued)

*Primary Examiner* — David P Angwin
*Assistant Examiner* — Nicholas A Ros
(74) *Attorney, Agent, or Firm* — Knobbe, Martens, Olson & Bear, LLP

(57) ABSTRACT

A spa pool cover lifter and a spa pool including a spa pool cover lifter are disclosed. The spa pool cover lifter may include a first arm pivotally attached to a first section of an articulated spa pool cover and a second arm pivotally attached to a second section of the articulated spa pool cover. The first and second arms may be configured such that rotation of the first arm causes the first and second sections of the spa pool cover to fold together. An actuator and controller is disclosed. A mechanical linkage between the actuator and first arm is disclosed. The mechanical linkage may be an over-rotation linkage.

20 Claims, 13 Drawing Sheets

(58) Field of Classification Search
CPC .. B65D 88/126; B65D 90/00; B65D 90/0046; B65D 90/06; E04H 4/082; E04H 4/084; E04H 4/088
See application file for complete search history.

(56) References Cited

U.S. PATENT DOCUMENTS 5,517,703 A 5/1996 Ouelette
5,566,403 A 10/1996 Black et al.
5,584,081 A 12/1996 Ouelette
5,634,218 A 6/1997 Ouelette
5,689,841 A 11/1997 Black et al.
5,819,332 A * 10/1998 Perry ..... E04H 4/084 4/496
5,950,252 A 9/1999 Fettes
5,974,599 A 11/1999 Tudor
5,974,600 A 11/1999 Pucci et al.
5,996,137 A 12/1999 Genova
6,000,071 A 12/1999 Fettes
6,000,072 A 12/1999 LaHay
6,032,305 A 3/2000 Tedrick
6,158,063 A 12/2000 Tudor
6,195,811 B1 3/2001 Dragovic
6,381,766 B1 5/2002 Perry
6,393,630 B1 5/2002 Tedrick
6,442,799 B1 9/2002 Duarte et al.
6,550,077 B1 4/2003 Tedrick
6,634,036 B2 10/2003 Tudor
6,665,890 B1 12/2003 Tedrick
6,718,566 B1 4/2004 Wilson
6,742,196 B2 6/2004 LaHay
6,795,984 B1 9/2004 Brady
6,802,086 B1 10/2004 Hudzinski
6,842,917 B1 1/2005 Genova
6,859,952 B2 3/2005 Perry
6,938,281 B1 9/2005 Tudor
7,073,213 B2 7/2006 Duarte et al.
7,146,656 B2 12/2006 Hagan
7,155,756 B1 * 1/2007 Helder ..... E04H 4/084 4/498
7,281,280 B2 10/2007 LaHay
7,290,297 B2 11/2007 Cunerty
7,308,722 B2 12/2007 Koren
7,412,733 B2 8/2008 Dorsch
7,461,415 B2 12/2008 Buzzetti et al.
7,480,946 B1 1/2009 Brown
7,496,975 B1 3/2009 Tudor
7,500,276 B2 3/2009 Koren
7,600,271 B2 10/2009 Piche et al.
7,600,272 B2 10/2009 Coleman et al.
7,614,093 B2 11/2009 Piche et al.
7,721,361 B1 5/2010 Shubert
7,752,685 B2 7/2010 Tudor
7,950,076 B2 5/2011 Koren
7,971,287 B2 7/2011 Buzzetti et al.
8,051,505 B1 11/2011 Horton
8,096,294 B1 1/2012 Jenkins
8,239,977 B2 8/2012 Sloss
8,261,378 B2 * 9/2012 Kanetis ..... E04H 4/065 4/500
8,468,617 B2 6/2013 Gardenier et al.
8,479,325 B2 7/2013 Gardenier et al.
8,516,625 B2 8/2013 Gardenier et al.
8,516,626 B2 8/2013 Gardenier et al.
8,578,524 B2 11/2013 Koren
9,080,340 B2 * 7/2015 Timischl ..... E04H 4/084
9,101,249 B1 8/2015 Tudor
9,181,721 B2 11/2015 Spicer
9,493,960 B2 11/2016 Spicer et al.
9,540,834 B2 1/2017 Spicer et al.
9,574,361 B2 * 2/2017 Dose ..... E04H 4/084
9,593,498 B2 * 3/2017 Wyrick ..... E04H 4/084
9,644,382 B1 5/2017 Turner
9,689,172 B1 * 6/2017 Genova ..... E04H 4/084
9,708,823 B2 7/2017 Cunerty et al.
9,845,607 B2 12/2017 Spicer
9,926,713 B1 3/2018 Livingston
10,180,009 B2 1/2019 Livingston
10,273,702 B1 4/2019 Cunerty
10,370,864 B2 8/2019 Gavin
10,415,264 B1 9/2019 Turner
10,435,899 B2 10/2019 Kadlecova et al.
10,487,523 B2 11/2019 Spicer et al.
10,487,524 B2 11/2019 Kadlecova et al.
10,519,680 B2 * 12/2019 Spicer ..... F16D 7/027
10,526,807 B2 1/2020 Spicer et al.
10,662,665 B2 5/2020 Cunerty
10,865,579 B2 12/2020 Spicer et al.
11,078,679 B2 * 8/2021 Tournas ..... E04H 4/084
11,078,680 B2 8/2021 Cunerty et al.
2004/0034915 A1 2/2004 Tedrick
2004/0107492 A1 6/2004 Cunerty
2004/0139540 A1 7/2004 LaHay
2004/0143895 A1 7/2004 Loyd
2006/0053543 A1 * 3/2006 Vargas ..... E04H 4/084 4/498
2006/0162060 A1 * 7/2006 Coleman ..... E04H 4/084 4/498
2009/0049595 A1 2/2009 Müller
2010/0011498 A1 1/2010 Coleman et al.
2010/0313352 A1 12/2010 Sloss
2011/0048654 A1 3/2011 Kolar
2012/0066828 A1 3/2012 Kite
2013/0031713 A1 2/2013 Kite
2016/0053505 A1 2/2016 Dose
2020/0095790 A1 3/2020 Spicer et al.
2020/0240160 A1 7/2020 Spicer et al.
2021/0032887 A1 2/2021 Tournas et al.

FOREIGN PATENT DOCUMENTS

EP 2028333 B1 11/2011
EP 2444570 A1 4/2012
EP 2694758 B1 5/2016
EP 2313578 B1 10/2018
EP 3392432 A1 10/2018
EP 3527749 A1 8/2019
GB 2579410 * 6/2020 ..... E04H 4/084
WO WO 2021025944 A1 2/2021

OTHER PUBLICATIONS

180 Degree Rotation with Linear Actuator (retrieved from internet Aug. 5, 2021) https://www.homecsp.com/node/136 whole document.

* cited by examiner

SPA POOL COVER LIFTER, AND A SPA POOL INCLUDING A SPA POOL COVER LIFTER

FIELD

This invention relates to a spa pool cover lifter and to a spa pool incorporating such a spa pool lifter.

BACKGROUND

Spa pools may include covers used to cover the spa pool when it is not in use. Some covers may be articulated and may include two or more articulated sections, while other covers may be monolithic or may comprise a single section. Covers may be difficult or inconvenient to ergonomically handle due to their size, shape, and/or weight, and a spa pool cover lifter may be used to assist a person to remove or replace the cover to or from the spa pool.

Spa pool cover lifters for lifting articulated covers are known. These designs may include an arm connected in some way to an articulated section of the cover. The user of the spa pool cover lifter may have to manually fold one articulated section of the spa pool cover over the other section of the spa pool cover before the spa pool cover lifter can be used to remove the cover from the spa pool. This may pose an inconvenience for the user and may even preclude the use of the spa pool cover lifter if the person is unable to fold the articulated cover without assistance (e.g. due to their age, infirmities, and/or weight or other characteristic of the cover itself.)

Some of these designs may include actuators to actuate the cover lifter, but the articulated sections of the cover lifter may still need to be manually brought together before the actuator is engaged. The use of an actuator does not reduce this inconvenience in these circumstances.

The articulated cover itself may include an integrated actuator or some other arrangement to bring the articulated sections of the cover together before the articulated cover is lifted from the spa pool. These arrangements may be complex and costly, and may restrict the different types of covers compatible with the spa cover lifter. The weight of the cover may also be increased in order to accommodate the arrangement used to bring the sections together.

Other spa pool cover lifters may include an arm with some connection to an articulated section of the cover, and may not require the user to fold the articulated sections together before the spa cover lifter is engaged. However, these cover lifters may be incapable of removing the cover completely from the rim or top face of the spa, and the cover may still be supported by the spa rim even when it is in the 'uncovered' position. Users may wish to remove the cover so that it is stowed at least partially, if not completely, beneath the rim of the spa.

SUMMARY

In some configurations, a spa pool including a spa cover having articulated sections and a spa pool cover lifter for removing the spa pool cover can comprise a first arm rotatable about a first pivotal connection to a side of the spa pool and pivotally connected to a first section of the spa pool cover; a second arm rotatable about a second pivotal connection to a side of the spa pool and pivotally connected to a second section of the spa pool cover; wherein the arms are configured such that rotation of the first arm causes the first and second sections of the spa pool cover to fold together and move from a position covering the top of the spa pool to a position in which the spa pool is accessible.

In some configurations, the spa cover lifter of the spa pool can include a third arm, opposite the first arm, rotatable about a third pivotal connection to an opposite side of the spa pool and pivotally connected to the first section of the spa pool cover; and a fourth arm, opposite the second arm, rotatable about a fourth pivotal connection to an opposite side of the spa pool and pivotally connected to the second section of the spa pool cover.

In some configurations, the spa cover lifter of the spa pool can include at least one actuator configured to actuate the rotation of the first and/or third arm about its respective pivotal connection.

In some configurations, the at least one actuator can be a linear actuator.

In some configurations, the at least one actuator can be a hydraulic piston.

In some configurations, a mechanical linkage is provided between each actuator and respective first or third arm.

In some configurations, each mechanical linkage can convert linear translation of the respective actuator to rotation of the first and/or third arm about its pivotal connection.

In some configurations, each mechanical linkage can include an eccentric drive plate connected to the first and/or third arm.

In some configurations, each mechanical linkage can include an over-rotation linkage between each respective linear actuator and each eccentric drive plate.

In some configurations, each over-rotation linkage can allow rotation of a respective arm through between 150 to 180 degrees of movement.

In some configurations, each over-rotation linkage can include a first plate rotatably connected to a side of the spa pool about a first rotatable connection and a linear actuator about a second rotatable connection; and a second plate rotatably connected to the eccentric drive plate about a third rotatable connection and the first plate about a fourth rotatable connection.

In some configurations, the spa cover lifter of the spa pool can include a controller configured to operate and control each actuator.

In some configurations, the controller can include a receiving module configured to receive a wireless signal.

In some configurations, the controller can include a user interface in operative communication with the controller.

In some configurations, the user interface can include a button.

In some configurations, the user interface can include a cylinder configured to receive a key.

In some configurations, the user interface can be a live man switch.

In some configurations, the controller can prevent or interrupt operation of each actuator if an obstruction is detected.

In some configurations, the controller can detect an obstruction by monitoring the torque or force transmitted by the actuator.

In some configurations, the articulation between the first section of the spa pool cover and the second section of the spa pool cover can run along a length of the spa pool cover.

In some configurations, the articulation between the first section of the spa pool cover and the second section of the spa pool cover can run along a width of the spa pool cover.

In some configurations, the spa pool cover can be substantially rigid.

In some configurations, the spa pool cover can buckle in a fail-safe mode when an excessive weight is placed on the spa pool cover.

In some configurations, the spa pool cover can include a first inflatable bladder and a second inflatable bladder within a slipcover.

In some configurations, the first inflatable bladder and second inflatable bladder can be made of a drop stitch construction including a top skin, a bottom skin, and a fibre core comprising a plurality of tension fibres extending between the top and bottom skins.

In some configurations, the spa pool cover can be partially below a top rim of the spa pool when the spa pool cover is in the position in which the spa pool is accessible.

In some configurations, the majority of the spa pool cover can be below a top rim of the spa pool when the spa pool cover is in the position in which the spa pool is accessible.

In some configurations, the spa pool cover can be substantially below a top rim of the spa pool when the spa pool cover is in the position in which the spa pool is accessible.

In some configurations, the spa pool cover can be completely below a top rim of the spa pool when the spa pool cover is in the position in which the spa pool is accessible.

In some configurations, at least a portion of the spa pool cover can be substantially flush with a side of the spa pool when the spa pool cover is in the position in which the spa pool is accessible.

In some configurations, a spa pool cover lifter for moving a spa cover having articulated sections from a spa pool can comprise a first arm rotatable about a mount at its proximal end and pivotally connectable to a first section of the spa pool cover at its distal end; a second arm rotatable about a mount at its proximal end and pivotally connectable to a second section of the spa pool cover at its distal end; wherein the arms are configured such that, in use, the rotation of the first arm about its mount causes the first and second spa cover sections to fold together and move from a position covering a top of the spa pool to a position in which the spa pool is accessible.

In some configurations, the spa cover lifter can include an actuator configured to actuate the rotation of the first arm about its mount at its proximal end.

In some configurations, the actuator can be a linear actuator.

In some configurations, the actuator can be a hydraulic cylinder.

In some configurations, a mechanical linkage can be provided between the actuator and the first arm.

In some configurations, the mechanical linkage can convert a linear translation of the linear actuator to rotation of the first arm about its mount.

In some configurations, the mechanical linkage can include an eccentric drive plate connected to the first third arm.

In some configurations, the mechanical linkage can include an over-rotation linkage between the linear actuator and the eccentric drive plate.

In some configurations, the over-rotation linkage can allow rotation of the first arm through between 150 to 180 degrees of movement.

In some configurations, the over-rotation linkage can include a first plate rotatably connected to a frame about a first rotatable connection and the linear actuator about a second rotatable connection; and a second plate rotatably connected to the eccentric drive plate about a third rotatable connection and the first plate about a fourth rotatable connection.

In some configurations, the spa cover lifter can include a controller configured to operate and control the actuator to effect rotation of the first arm.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e., they will be taken to mean an inclusion of the listed components which the use directly references, and possibly also of other non-specified components or elements.

Reference to any document in this specification does not constitute an admission that it is prior art, validly combinable with other documents or that it forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention, in which.

DETAILED DESCRIPTION

Figure 1A:
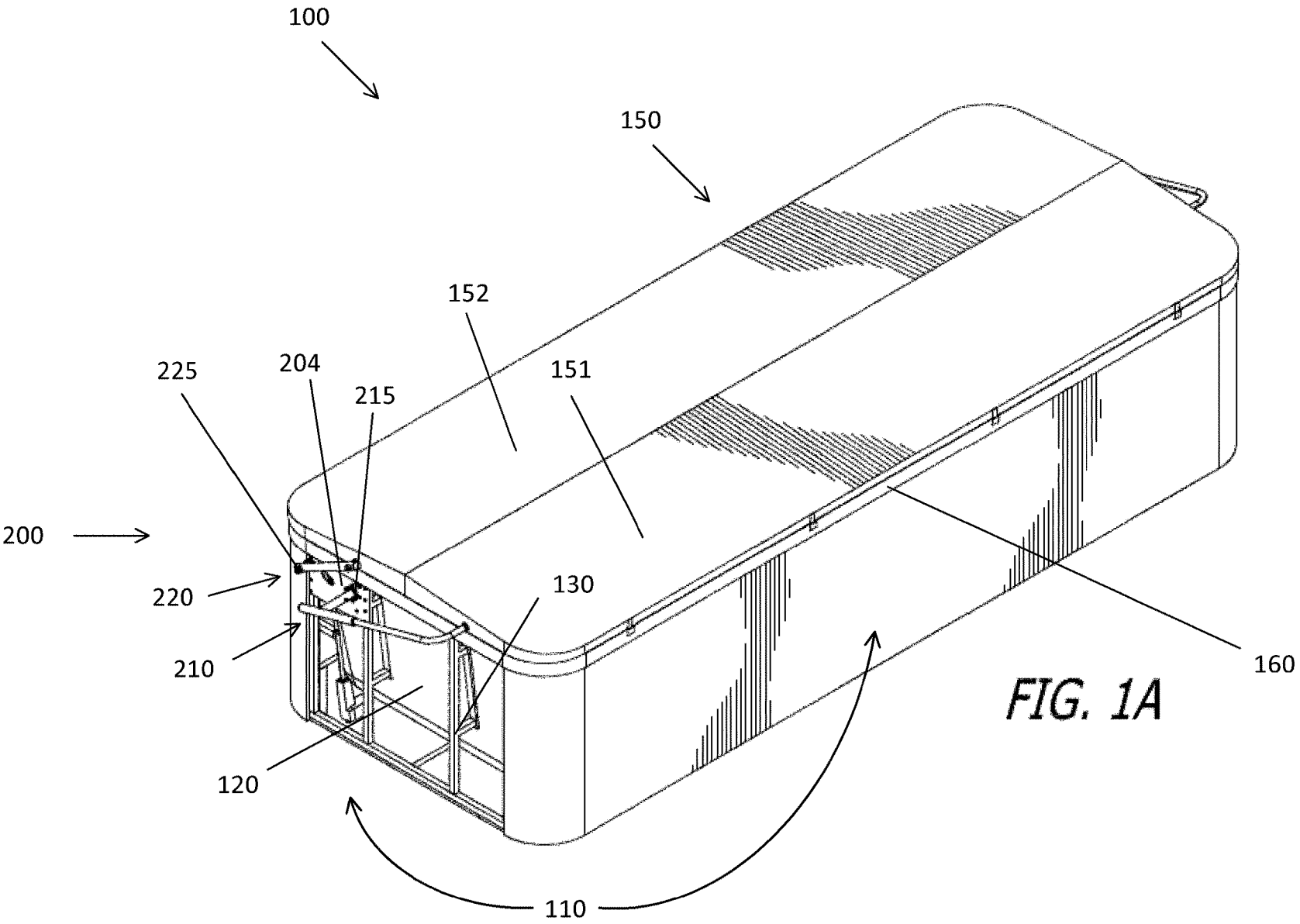
FIG. 1A is a perspective view of a spa pool according to one example embodiment with a side cover panel removed.
Figure 1B:
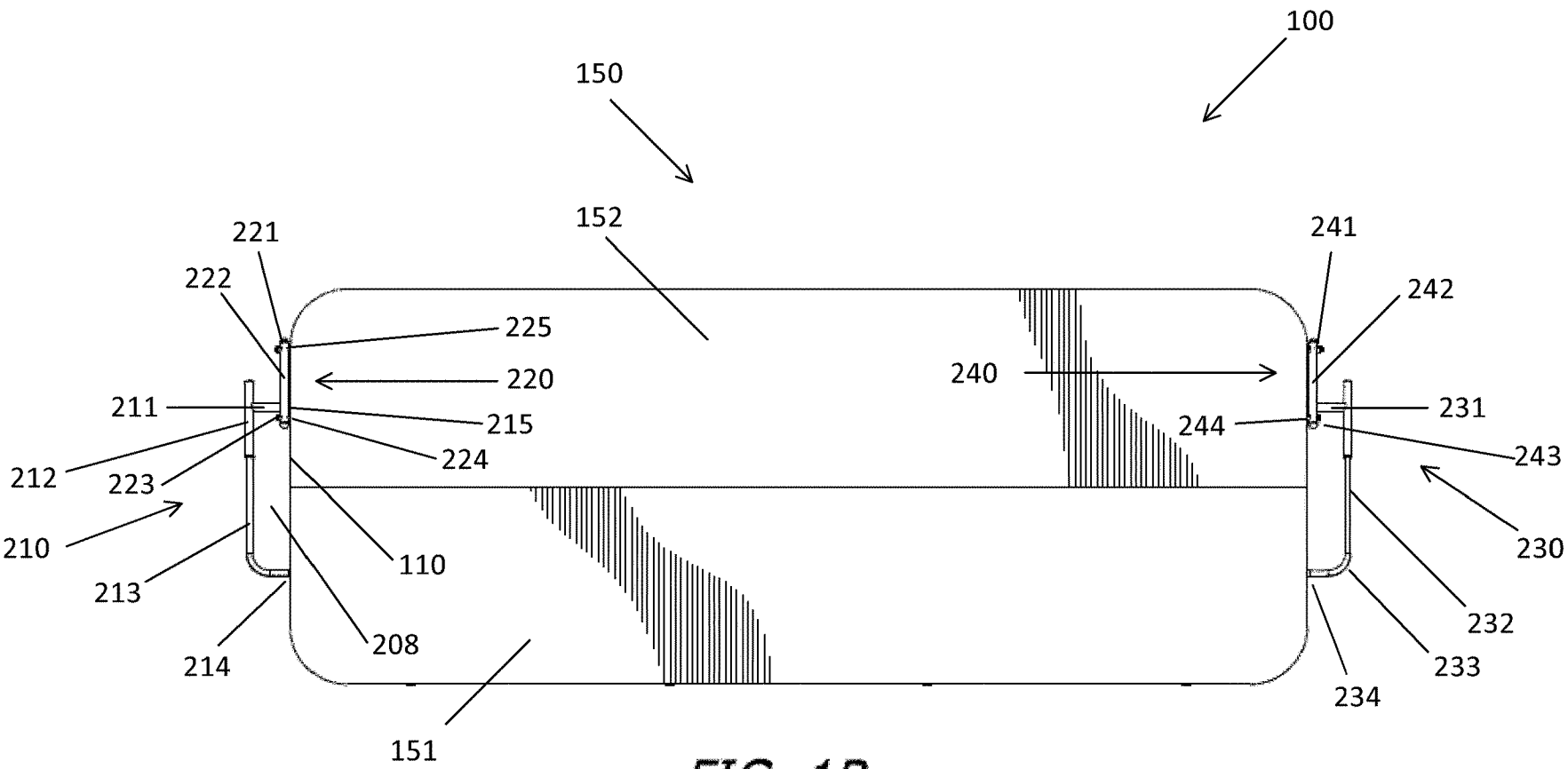
FIG. 1B is a top view of the spa pool shown in FIG. 1.

FIGS. 1A and 1B illustrate a spa pool 100 according to an example embodiment. The spa pool 100 has one or more exterior sides 110 (one of which is not depicted to reveal the cover lifting mechanism) which at least partially surround a tub 120. The sides are usually connected to a frame 130 which structurally supports the weight of the tub 120. The tub 120 is typically filled with heated water and is accessible to a user through an opening in the top face 140 (depicted in FIG. 3) of the spa pool 100. When the spa pool 100 is not in use, the top face 140 of the spa pool 100 may be covered by a spa pool cover 150 in order to mitigate heat loss and to prevent debris from entering the tub 120. If a person wishes to use the spa pool 100, they must lift and move the spa pool cover 150 from its covering position to a position in which the spa pool 100 is accessible. The person may then replace the spa pool cover 150 back into the covering position once they have finished using the spa pool 100.

The example embodiment of the spa pool 100 illustrated in FIGS. 1A and 1B shows the spa pool 100 with the spa pool cover 150 in the covering position. In this position, the spa pool cover 150 lies substantially flush with (and is supported by) a rim 160 of the spa pool 100. The rim 160 of the spa pool 100 may be defined by the top edge of the tub 120 and/or the sides 110 of the spa pool 100, depending on their relative heights and construction. The spa pool cover 150 has a plurality of articulated sections and includes a first section 151 and a second section 152, although in other embodiments the spa pool cover 150 may have additional articulated sections. The spa pool cover 150 may be substantially rigid and may include one or more straps or latches 159 (indicated in FIG. 2) to secure the one or more sections 151 and 152 to the rim 160 or side 110 of the spa pool 100 when the spa pool cover 150 is in the covering position.

The articulation between the first section 151 and second section 152 of the spa pool cover 150 allows the two sections to fold together. With respect to the example embodiment depicted in FIG. 2, the spa pool cover 150 is articulated so that the first section 151 is able to fold counter-clockwise towards the second section 152, while the second section 152 is able to fold clockwise towards the first section 151. In some embodiments, the articulation may be formed from one or more webbings or flaps formed of a durable material and connected to each section 151 and 152. Suitable materials may include polyester or other synthetic fibres with the appropriate material properties. Furthermore, although the embodiment of the spa pool 100 depicted in FIGS. 1A and 1B includes a cover 150 which is articulated along its length, other embodiments may include spa pool covers 150 which are articulated along their width. The orientation of the articulation is not limited and may depend at least on the size and shape of the spa pool 100 and spa pool cover 150.

The spa pool cover 150 may also be configured to buckle in a fail-safe mode when an excessive weight is placed on its top face. This is a safety feature which may help mitigate serious injury if a person stands on the cover 150 and is too heavy for the cover 150 to fully support. In some embodiments, the spa pool cover 150 may comprise a first inflatable bladder and a second inflatable bladder within a slipcover. The first and second inflatable bladders may be made of a drop stitch construction including a top skin, a bottom skin, and a fibre core comprising a plurality of tension fibres extending between the top and bottom skins. Embodiments of spa pool covers 150 having these constructions are disclosed in U.S. Pat. No. 9,127,471, which is incorporated herein by reference in its entirety.

The spa pool 100 also includes a spa pool cover lifter 200. A cover lifter 200 may be provided on one or both sides of the spa pool. In the example described below cover lifter mechanisms are provided on both sides but operation of a single side will be provided for ease of description. The spa pool cover lifter 200 is used to move the spa pool cover 150 from a position covering the top 140 of the spa pool 100 to a position in which the spa pool 100 is accessible, and vice versa. The spa pool cover lifter 200 includes a first arm 210 and a second arm 220. The first arm 210 is rotatable about a first pivotal connection 215 to a side of the spa pool 100 and is pivotally connected to the first section 151 of the spa pool cover 150. The second arm 220 is rotatable about a second pivotal connection 225 to a side of the spa pool 100 at one end and is pivotally connected to the second section 152 of the spa pool cover 150. The first and second arms 210 and 220 are configured so that when the spa pool cover 150 is in the covering position (as depicted in the non-limiting illustration in FIG. 2), anticlockwise rotation of the first arm 210 causes the first and second sections 151 and 152 of the spa pool cover 150 to fold together and move from the covering position to a position in which the spa pool 100 is accessible. This process is illustrated in FIGS. 2 to 10 according to one example embodiment.

In the non-limiting embodiment depicted in FIGS. 1A to 10, the proximal end of the first arm 210 comprises a first shaft 211 which extends outwardly from the first pivotal connection 215 to the side 110 of the spa. The longitudinal axis of the first shaft 211 is substantially orthogonal to the side of the spa pool 110 and is substantially orthogonal to the plane of rotation of the first pivotal connection 215. The first arm 210 further comprises a second shaft 212, the longitudinal axis of which is generally at a right angle to the first shaft 211 and is parallel to the plane of rotation of the first pivotal connection 215. The arrangement between the first shaft 211, the second shaft 212, and the first pivotal connection 215 of the first arm 210 means that the first arm 210 defines a clearance volume 208 between the side 110 of the spa pool and the first arm 210. This is best shown with reference to FIG. 1B.

Figure 11:
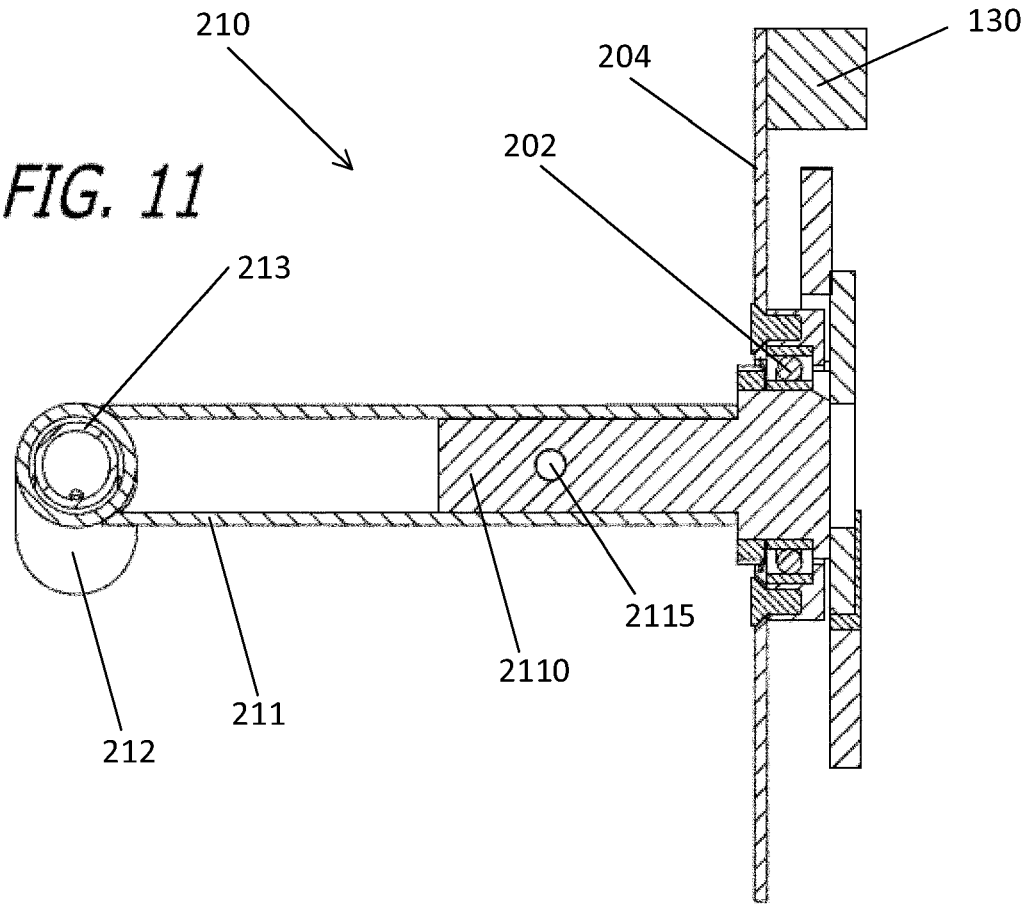
FIG. 11 is a cross sectional view of a pivotal connection of a first arm of a spa cover remover of the spa pool shown in FIG. 1.

A bearing 202 (depicted in FIG. 11) is used to rotatably connect the proximal end 211 of the first arm 210 to the side of the spa 110 at the first pivotal connection 215. The bearing 202 itself may be supported by a mounting plate 204 which in turn is attached to the frame 130 of the spa pool 100 in order to support the load maintained by the first arm 210. The bearing 202 may be a deep-groove ball bearing, although any bearing capable of supporting a sufficient radial load may be used depending on the application of the spa pool cover lifter 200.

In some embodiments, the first shaft 211 of the first arm 210 may be seated directly within the bearing 202 to define the first pivotal connection 215 at the proximal end of the first arm 210. In other embodiments, the first shaft 211 of the first arm 210 may not be directly supported by the bearing 202, but may instead surround and enclose a concentric inner shaft 2110 (also shown in FIG. 11) which in turn is supported by the bearing 202. The first shaft 211 and the concentric inner shaft 2110 may be connected by a shear pin 2115 passing radially through the first shaft 211 and concentric inner shaft 2110 and connecting the two together. The shear pin 2115 may be configured to transfer force or torque between the first shaft 211 and concentric inner shaft 2110 under usual circumstances, but may be selected to intentionally fail when the torque or force exceeds a predetermined magnitude or threshold. This may increase the safety of the spa cover lifter and may prevent damage to the bearing 202 supporting the first arm 210 at its first pivotal connection 215 to the side 110 of the spa pool 100. Whether or not a shear pin 2115 is used and, if so, the magnitude of the torque or force at which it fails may depend on the application of the spa pool cover lifter 200.

The second shaft 212 of the first arm 210 is connected to a third shaft 213 which may be substantially L-shaped. In some embodiments, the third shaft 213 may have a telescoping arrangement with the second shaft 212 or may have a fixed connection with the second shaft 212. The distal end 214 of the third shaft 213 is pivotally connected to the first section 151 of the spa pool cover 150. In some embodiments, the first section 151 of the spa pool cover 150 may include a bearing which receives the distal end 214 of the third shaft 213 and enables a pivotal connection between the two. In other embodiments, the first section 151 of the spa pool cover 150 may include a pipe sleeve which passes through at least a portion of the length of the first section 151 of the spa pool cover 150 and is fixed in relation to the first section 151 of the spa pool cover 150. This construction may be particularly suitable where a cover lifting mechanism is provided on only one side of the spa pool. The pipe sleeve may at least partially define an aperture on a side of the first section 151 of the spa pool cover 150, and the distal end 214 of the third shaft 213 may be concentrically received by this aperture and the interior of the pipe sleeve within the first section 151 of the spa pool cover 150 to enable a pivotal connection between the distal end 214 of the third shaft 213 and the first section 151 of the spa pool cover 150. Bushings or the like may also be used to reduce friction between the pipe sleeve and distal end 214 of the third shaft 213.

Figure 12:
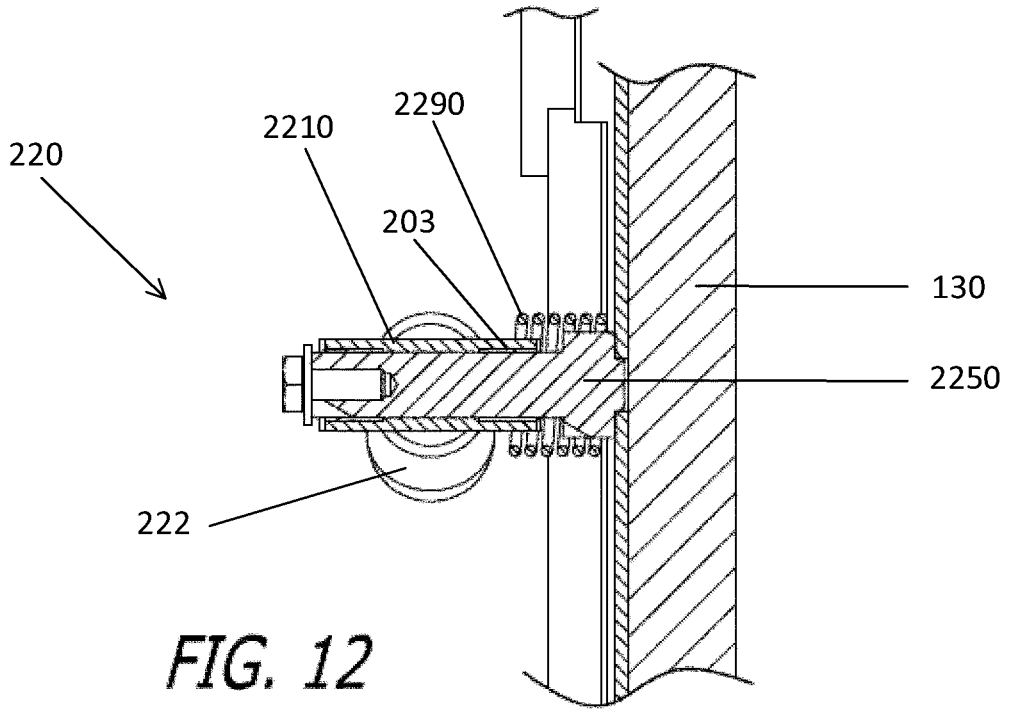
FIG. 12 is a cross sectional view of a pivotal connection of a second arm of the spa cover remover of the spa pool shown in FIG. 1.

The proximal end 221 of the second arm 220 of the spa pool cover lifter 200 is also pivotally connected to a side 110 of the spa 100 through a second bearing 203 (depicted in FIG. 12) at a second pivotal connection 225. In some embodiments of the spa pool cover lifter 200, the second bearing 203 may be a deep groove ball bearing capable of withstanding a significant radial force or torque. However, the second arm 220 of the spa pool cover lifter 200 will usually experience a smaller force or torque than the first arm 210 of the spa pool cover lifter 200 while the spa pool cover 150 is being moved, and a dedicated deep groove ball bearing may be unnecessary.

In other embodiments, the second pivotal connection 225 between the proximal end 221 of the second arm 220 and the side 110 of the spa pool 100 may comprise a cylindrical pivot pin 2250 (also depicted in FIG. 12) which may be attached or connected directly to the frame 130 of the spa pool 100 and may extend outwardly therefrom. A corresponding cylindrical pivot hub 2210 at the proximal end 221 of the second arm 220 of the spa pool cover lifter 200 may concentrically enclose the cylindrical pivot pin 2250. One or more flanged bushings (labelled 203 in FIG. 12) may be spaced between the pivot pin 2250 and the cylindrical pivot hub 2210 of the proximal end 221 of the second arm 210 to enable the second arm 210 to rotate about the concentric axis of the fixed pivot pin 2250.

The pivot hub 2210 of the proximal end 211 of the second arm 210 extends from the second pivotal connection 225 to the side 110 of the spa 100. The second arm 210 further comprises a second shaft 222 which is generally at a right angle to the pivot hub 2110 and is parallel with the plane of rotation of the second pivotal connection 225. The length of the second shaft 222 generally defines the radius of the arc which the second arm 210 sweeps out during the movement of the spa pool cover 150.

The second arm 220 of the spa pool cover lifter 200 may also include a torsion spring 2290 to help distribute the torque experienced by the second arm 220 during operation of the spa pool cover lifter 200. A first leg of the torsion spring 2290 may be fixed against the frame 130 of the spa pool 100 while a second leg of the torsion spring 2290 passes radially through the second shaft 222 of the second arm 210. If a torsion spring 2290 is included with the second arm 210 of the spa cover lifter 200, it may be configured so that it is neutrally biased (e.g. only exerts a negligible torque) when the spa pool cover 150 is in the covering position.

In other embodiments, the torsion spring 2290 may be configured so that it is neutrally biased when the spa pool cover 150 is in a position in which the spa pool 100 is accessible. In these embodiments, the torsion spring 2290 may be configured so that, when the spa pool cover 150 is in the covering position, it exerts a torque which urges the second section 152 of the spa pool cover 150 clockwise (i.e. towards the covering position), or may urge the second section 152 of the spa pool cover 150 anti-clockwise (i.e. towards a position in which the spa pool is accessible.) If a torsion spring 2290 is included in the spa cover lifter 200, its particular configuration will depend on the application of the spa cover lifter 200. The torsion spring may exert a torque of 100 Nm when it has rotated to its maximum extent during operation of the spa pool cover lifter 200. In some embodiments, this may correspond to a rotation through an arc of 150°-180°, 185°, or even higher in other embodiments.

Other embodiments may also use other springs or other arrangements to apply a bias to the second arm if necessary. As a non-limiting example, the torsion spring 2290 could be substituted with a leaf spring or a coil spring with the appropriate modifications. The exact arrangements used to apply a bias to the second arm 220 may depend on the application of the spa cover lifter 200.

The second arm 220 also includes a third shaft 223 (shown in FIG. 1B) which is substantially orthogonal to the second shaft 222 and is substantially parallel with the pivot hub 2210. The distal end 224 of the third shaft 223 is pivotally connected to the second section 152 of the spa pool cover 150 in a way similar to the pivotal connection between the first arm 210 and first section 151 of the spa pool cover 150, as described above.

In most embodiments of the spa cover lifter 200, the first arm 210 and second arm 220 are pivotally connected to the same side 110 of the spa pool 100. In these embodiments, the pivot hub 2210 of the second arm 210 is shorter than the first shaft 211 of the first arm 210, and the second shaft 222 of the second arm 220 is shorter than the second shaft 212 of the first arm 210. This means that if the first arm 210 and second arm 220 are pivotally connected to the same side 110 of the spa pool 100, the first pivotal connection 215 and second pivotal connection 225 can be positioned so that the second arm 220 remains entirely within the clearance volume 208 as defined by the first arm 210 at all times during the operation of the spa cover lifter 200. This enables the first arm 210 to sweep over and around the second arm 220 while the spa pool cover 150 is being lifted without either arm coming into contact with one another.

In other embodiments, the first arm 210 and second arm 220 may be positioned on different sides of the spa pool 100, and a clearance between the two arms may not be necessary.

As mentioned above, the spa cover lifter 200 in the illustrated example may include a complementary set of arms on the opposite side(s) of the first and second arm 210 and 220. More specifically, the spa cover lifter may include a third arm 230 opposite the first arm 210 and rotatable about a third pivotal connection at its proximal end 231. The third pivotal connection may be situated on the opposite side of the spa pool 100 to where the first pivotal connection 215 is located. The third arm 230, like the first arm 210, may be pivotally connected at its distal end 234 to the first section 151 of the spa pool cover 150. The spa cover lifter 200 may further include a fourth arm 240 opposite the second arm 220 and rotatable about a fourth pivotal connection at its proximal end 241. The fourth pivotal connection may be situated on the opposite side 150 of the spa pool 100 to where the second pivotal connection 225 is located. The fourth arm 240, like the second arm 220, may be pivotally connected at its distal end 244 to the second section 152 of the spa pool cover 150. This is best shown with respect to FIG. 1B.

In these embodiments, the complementary set of the third and fourth arms 230 and 240 will usually be symmetric to the first and second arms 210 and 220 and will usually have the same dimensions and construction, although they may differ depending on the application of the spa pool cover lifter 200. The third pivotal connection may be implemented in any of the ways in which the first pivotal connection 215 may be implemented. Similarly, the fourth pivotal connection may be implemented in any of the ways in which the second pivotal connection 225 may be implemented. The fourth arm 240 may also include a torsion spring in the same way that the second arm 220 may include a torsion spring 2290, depending on the application of the spa pool cover lifter 200.

The configuration of the pivotal connections between each section 151 and 152 of the spa pool cover 150 and the distal ends (214, 224, and/or 234, and/or 244) of the respective arms (210, 220, and/or 230, and/or 240) may vary depending on the application of the spa cover lifter 200. In some embodiments, a section 151 or 152 of the spa pool cover 150 may include two bearings which are situated on opposite sides of the section 151 or 152 of the spa pool cover 150, and each bearing may receive the distal end (214, 224, and/or 234, and/or 244) of a respective arm (210, 220, and/or 230, and/or 240). In other embodiments, the distal ends (214, 224, and/or 234, and/or 244) of each respective arm (210, 220, and/or 230, and/or 240) may be received in one or more pipe sleeves within the section 151 or 152 of the spa pool cover 150. Each pipe sleeve may extend part-way through a respective section of the spa pool cover and receive the distal ends of the respective arms. Alternatively, a single pipe sleeve running through the entire length of a respective section of the spa pool cover may be used. In these embodiments, each respective arm may be connected with one or more intermediary pieces or may even be a single piece, and the first and third arms (and/or second and fourth arms) may form a contiguous U-shaped arm. These embodiments may be preferable if the spa pool cover 150 is sufficiently large and requires additional support and stability, although the configuration of the pivotal connection between each section of the spa pool cover 150 and the distal ends of its respective arms will depend on the specifics of the spa pool, the spa pool cover, and the spa pool cover lifter.

Operation of Spa Pool Cover Lifter

The operation of a non-limiting embodiment of the spa pool cover lifter 200 will now be described with reference to FIG. 2 to FIG. 10.

Figure 2:
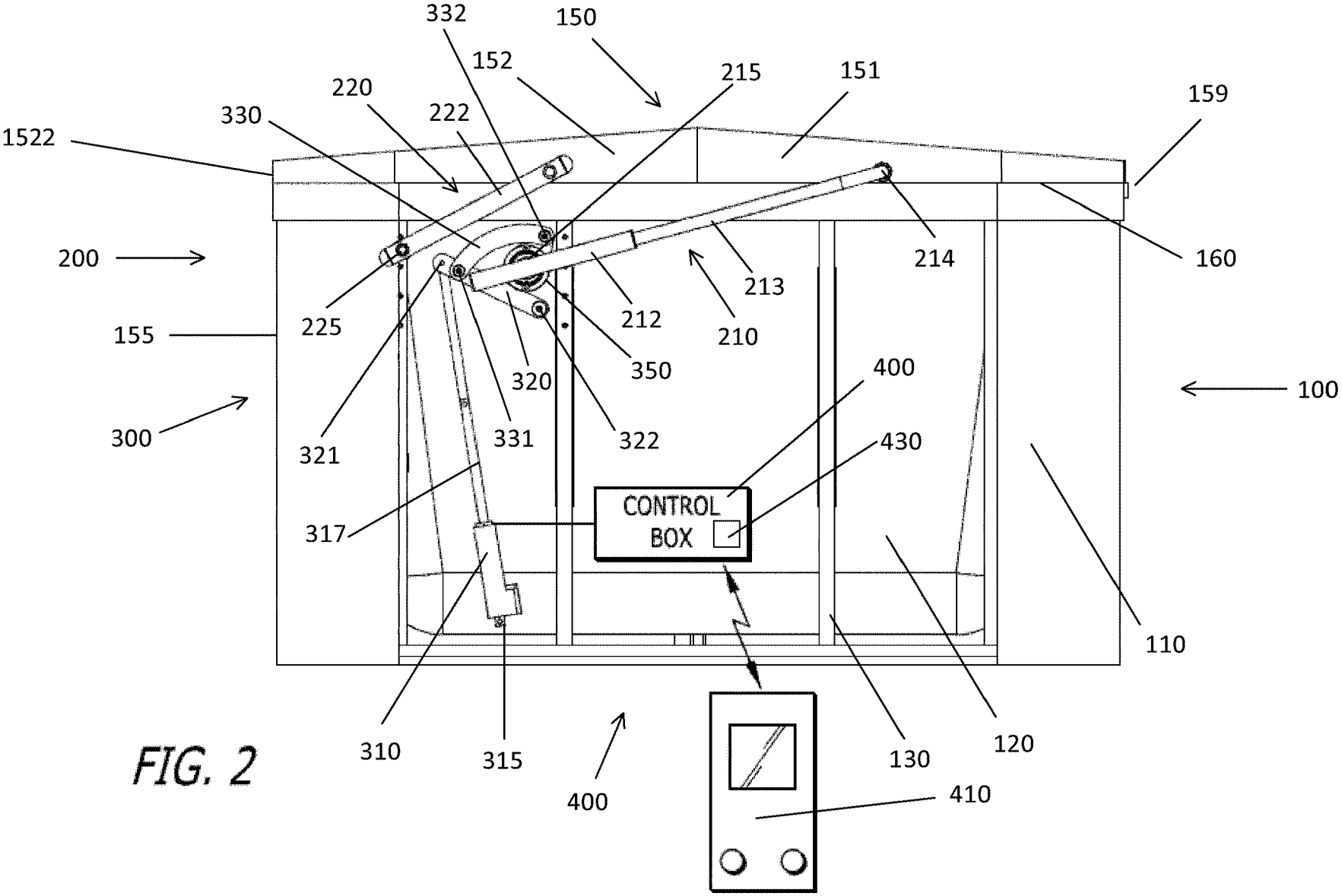
FIG. 2 is a side view of the spa pool shown in FIG. 1 with its spa pool cover in the closed position.
Figure 3:
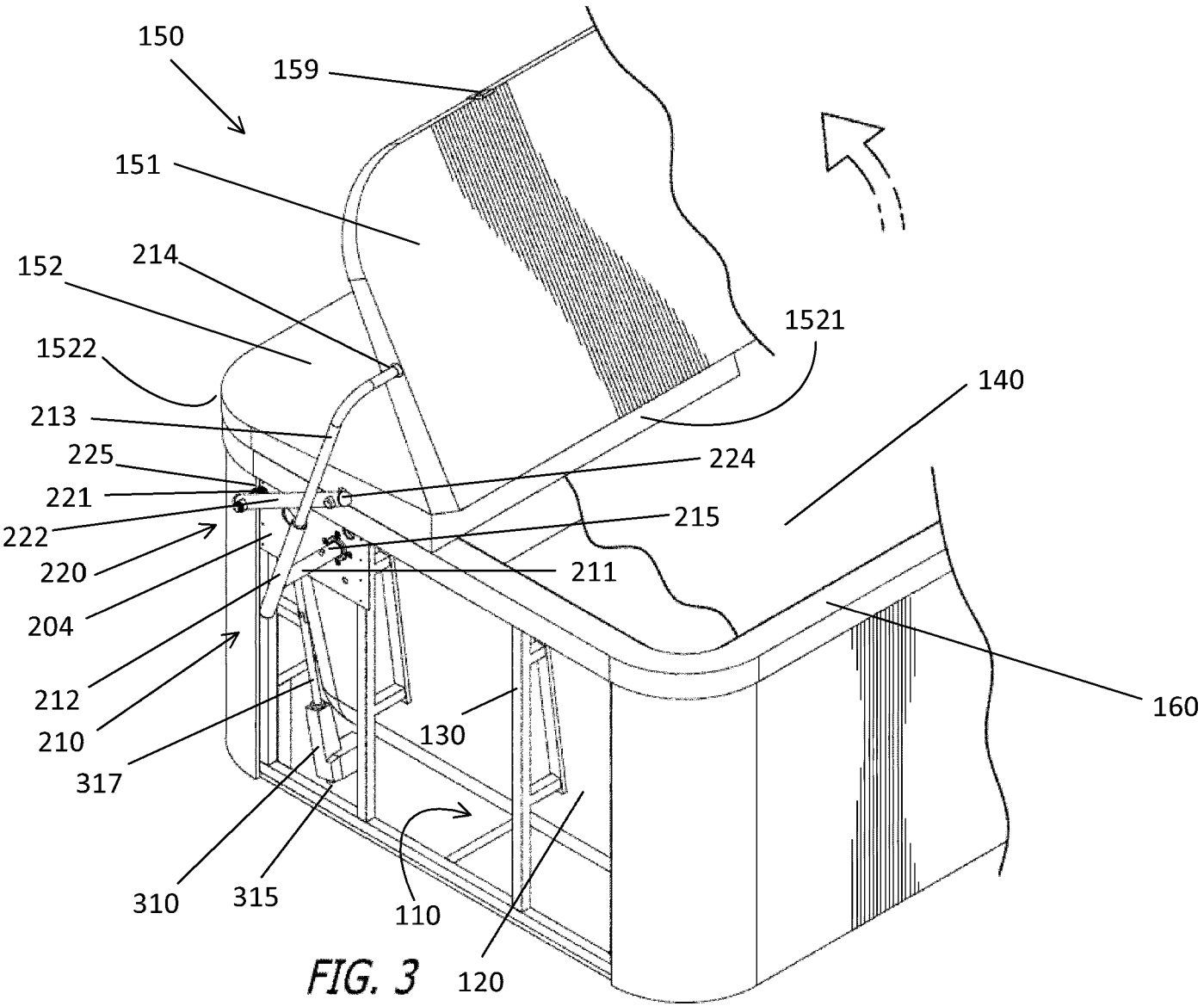
FIG. 3 is a perspective view of the spa pool shown in FIG. 1 with its spa pool cover partly removed.
Figure 4:
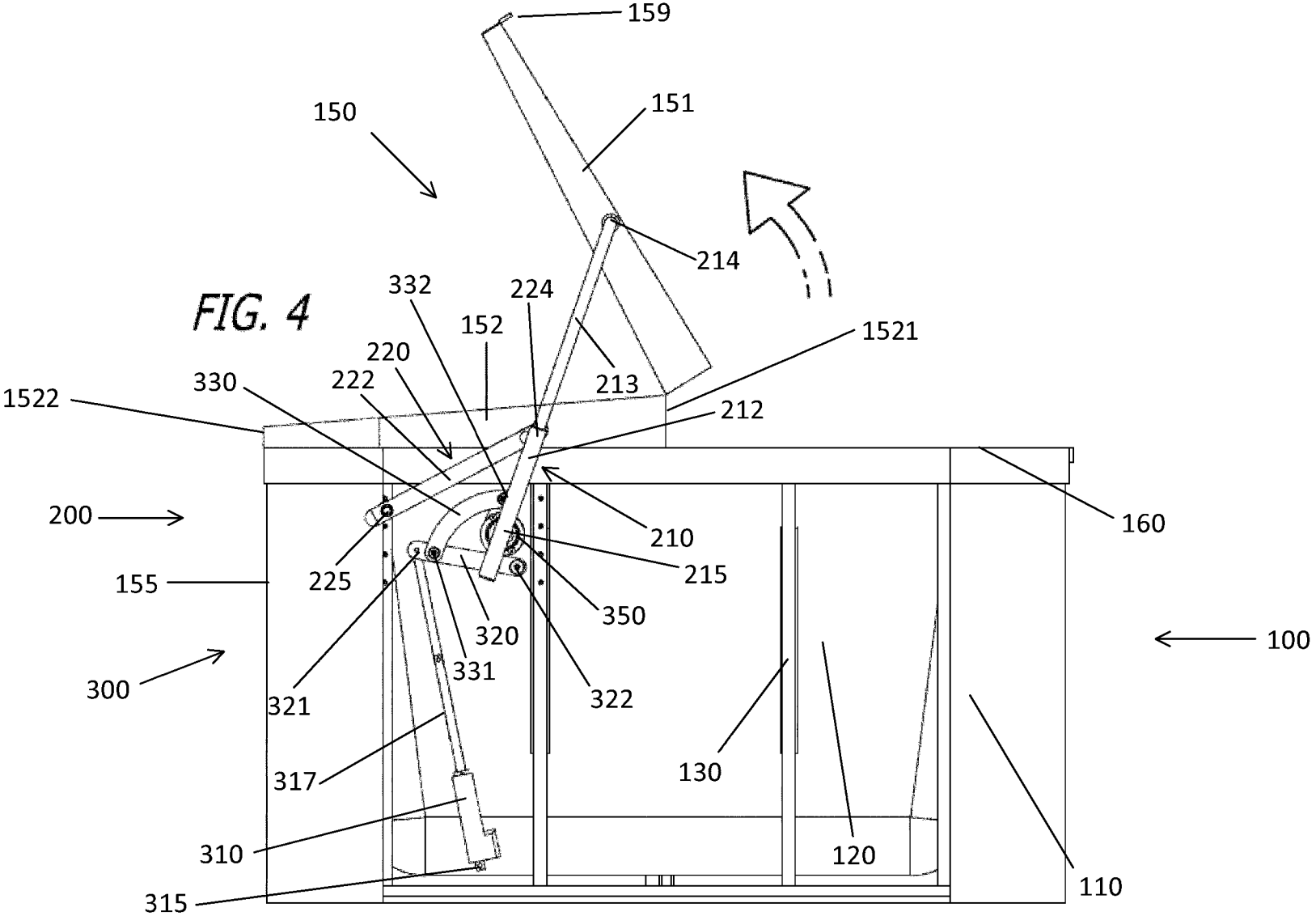
FIG. 4 is a side view of the spa pool depicted in FIG. 3.

FIG. 2 depicts an embodiment of the spa pool cover 150 in the closed position. First arm 210 is caused to rotate counter-clockwise (see description below) through a first arc with respect to the rim 160. The first section 151 of the spa pool cover 150 is thus raised from the rim of the spa 160 and begins to rotate and fold towards the second section 152 of the spa pool cover 150. This is depicted in FIGS. 3 and 4. In the embodiment depicted in FIGS. 2 to 10, the pivotal connection between the distal end 214 of the first arm 210 and the first section 151 of the spa pool cover 150, in conjunction with the articulation between the first section 151 and second section 152 of the spa pool cover 150, allows the first section 151 of the spa pool cover 150 to rotate and fold towards the second section 152 of the spa pool cover 150 while the second section 152 of the spa pool cover 150 remains substantially flush with the rim of the spa 160.

As the first arm 210 continues to rotate in the counter-clockwise direction, the height of the point at which the distal end 214 of the first arm pivotally connects with the first section 151 of the spa pool cover 150 continues to increase. In other words, the vertical distance between the distal end 214 of the first arm 210 and the rim of the spa 160 continues to increase as the first arm 210 approaches a 90° angle with respect to the rim of the spa 160.

Figure 5:
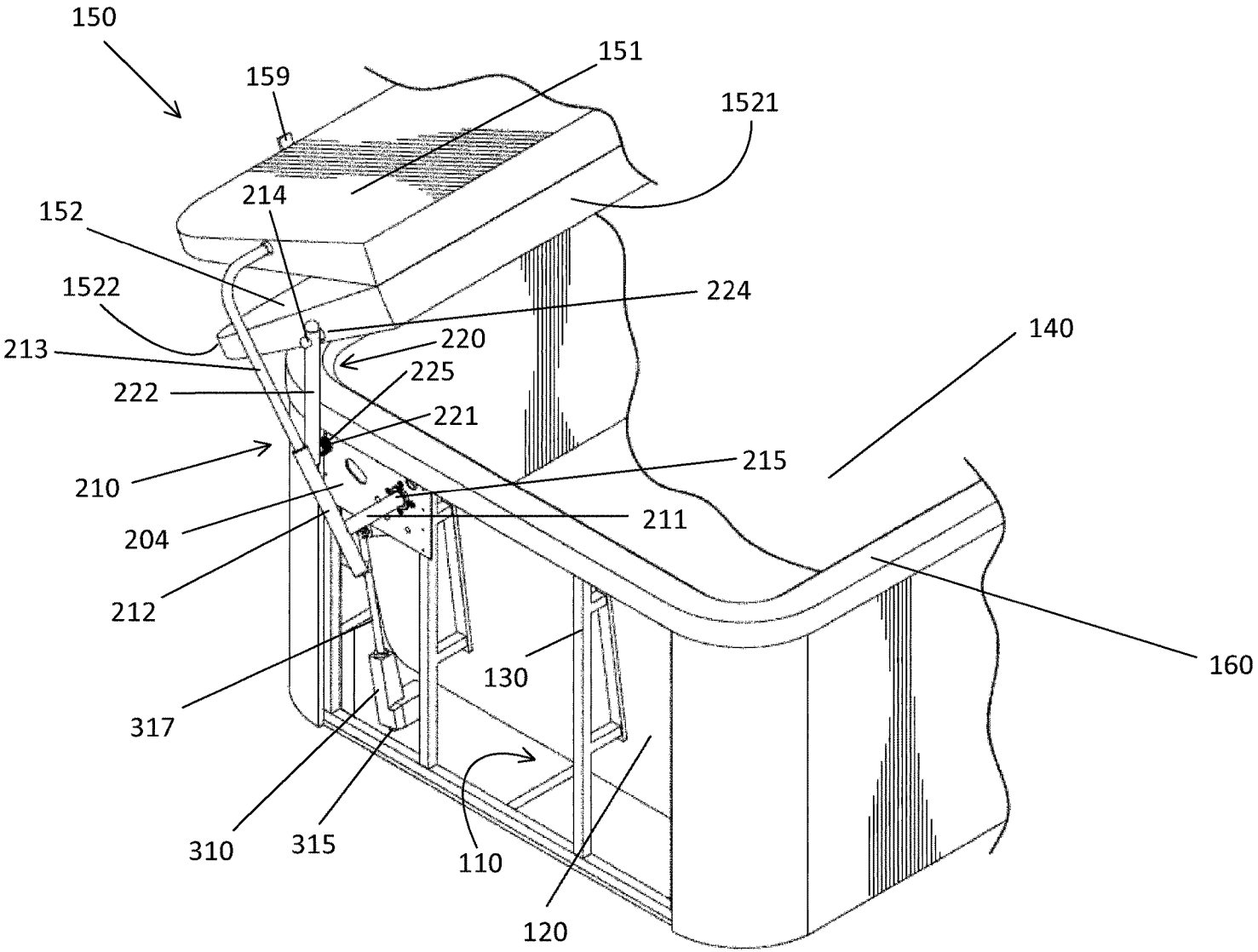
FIG. 5 is a perspective view of the spa pool shown in FIG. 1 with its spa pool cover further removed.
Figure 6:
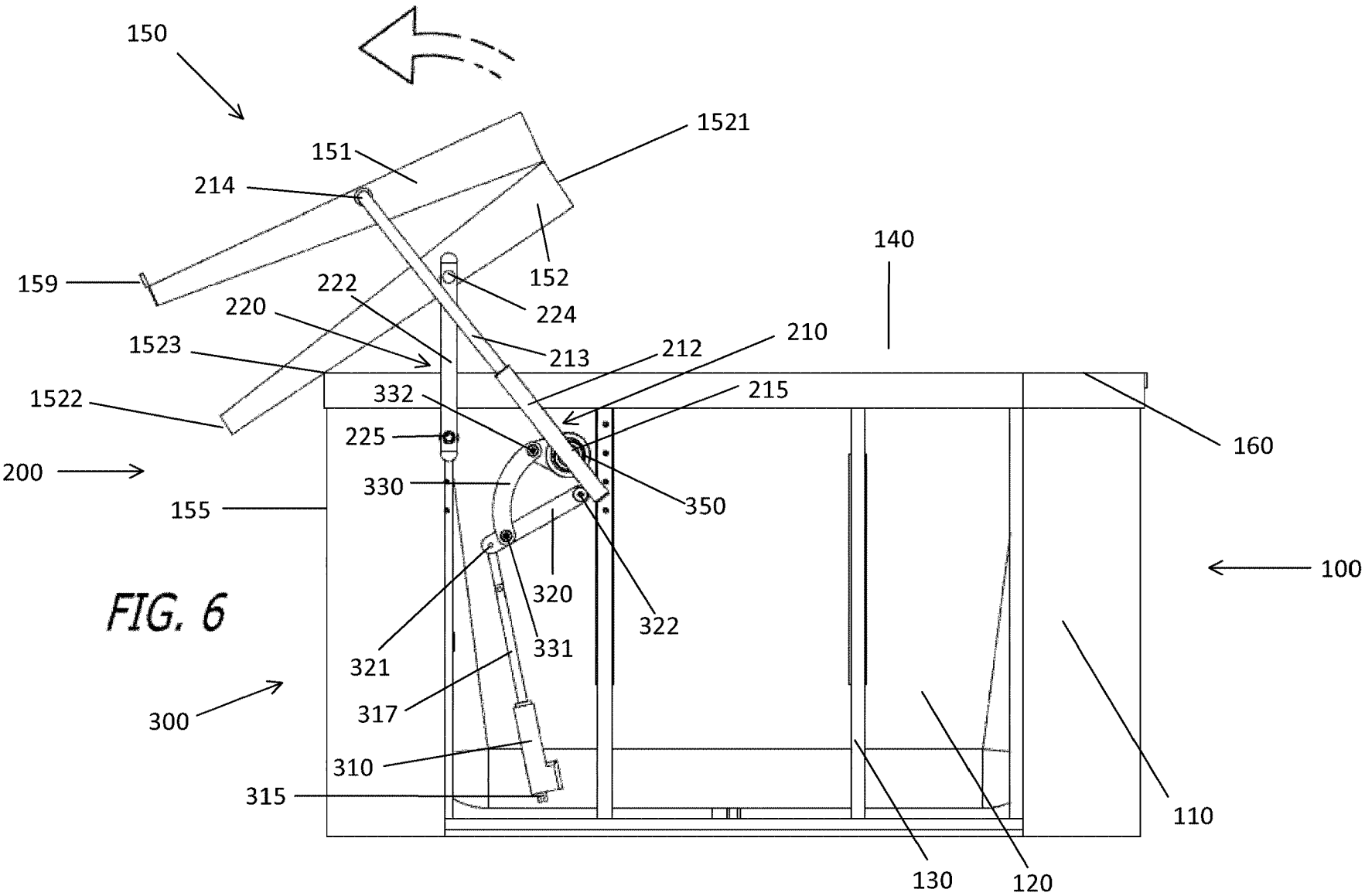
FIG. 6 is a side view of the spa pool depicted in FIG. 5.

Once the first arm 210 reaches a critical angle (corresponding to a critical height of the pivotal connection between the first arm 210 and the first section 151 of the spa pool cover 150), further rotation of the first section 151 of the spa pool cover 150 about its pivotal connection to the first arm 210 raises the articulated edge 1521 of the second section 152 of the spa pool cover 150 from the rim of the spa 160 due to the articulated connection between the two sections 151 and 152. However, as the second section 152 of the spa pool cover 150 is constrained to pivotally rotate about its connection to the second arm 220, the second arm 220 begins to rotate in the counter-clockwise direction about its pivotal connection 225 to the side of the spa 150 to accommodate the vertical displacement of the articulated edge 1521 of the second section 152 from the rim of the spa 160. The far edge 1522 of the second section 152 of the spa pool cover 150 correspondingly rotates with the articulated edge 1521 of the second section 152 so that it is below the rim 160, as shown in FIGS. 5 and 6. The second section 152 contacts the rim 160 at point 1523 between the far edge 1522 and articulated edge 1521. This constrains the amount to which the second section 152 of the spa pool cover 150 can pivot about its pivotal connection with the distal end 224 of the second arm 220. This constraint causes the first and second section 151 and 152 of the spa pool cover 150 to fold closer together as the first and second arm 210 and 220 continue to rotate in the counter-clockwise direction.

Figure 7:
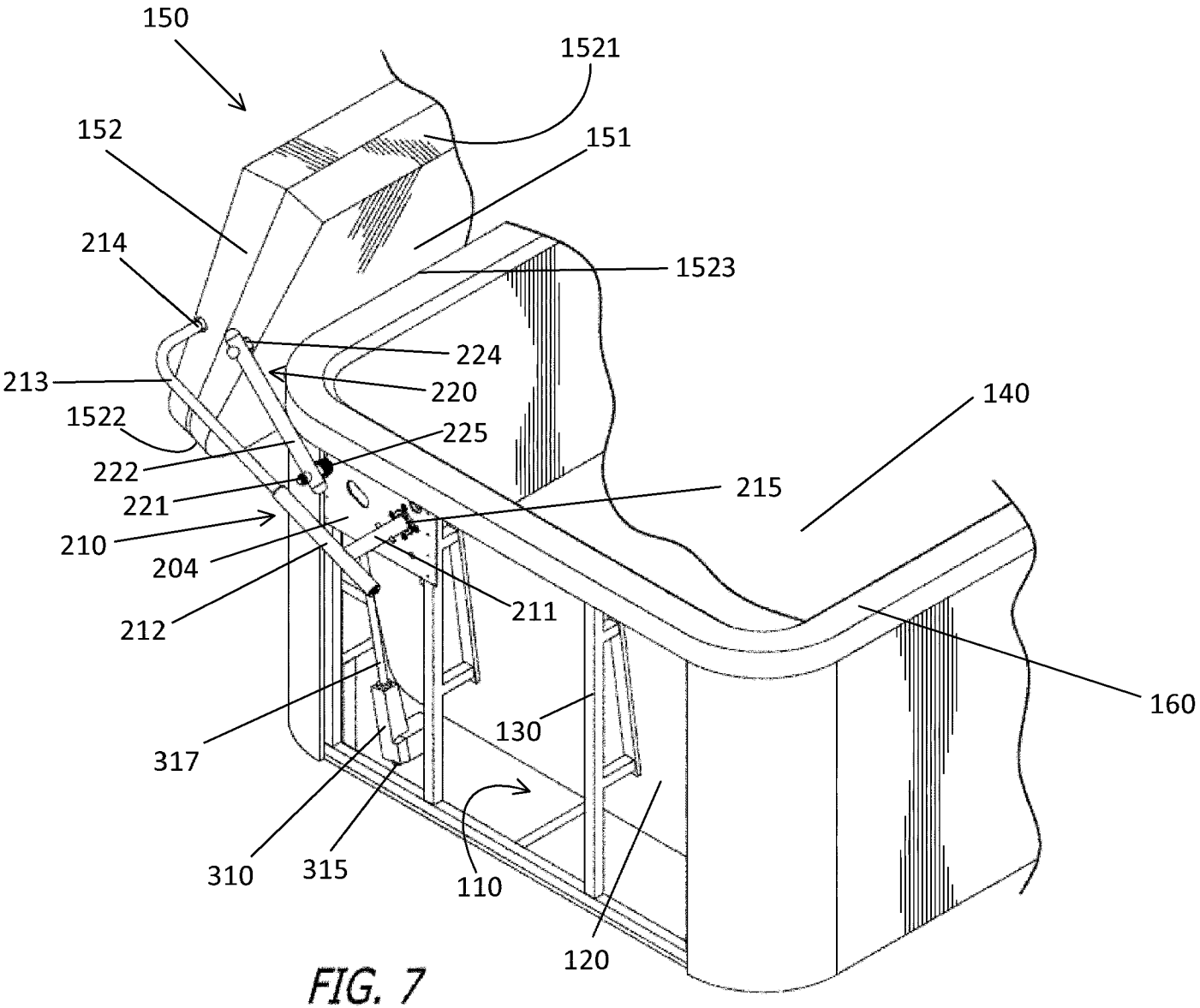
FIG. 7 is a perspective view of the spa pool shown in FIG. 1 with its spa pool cover still further removed.
Figure 8:
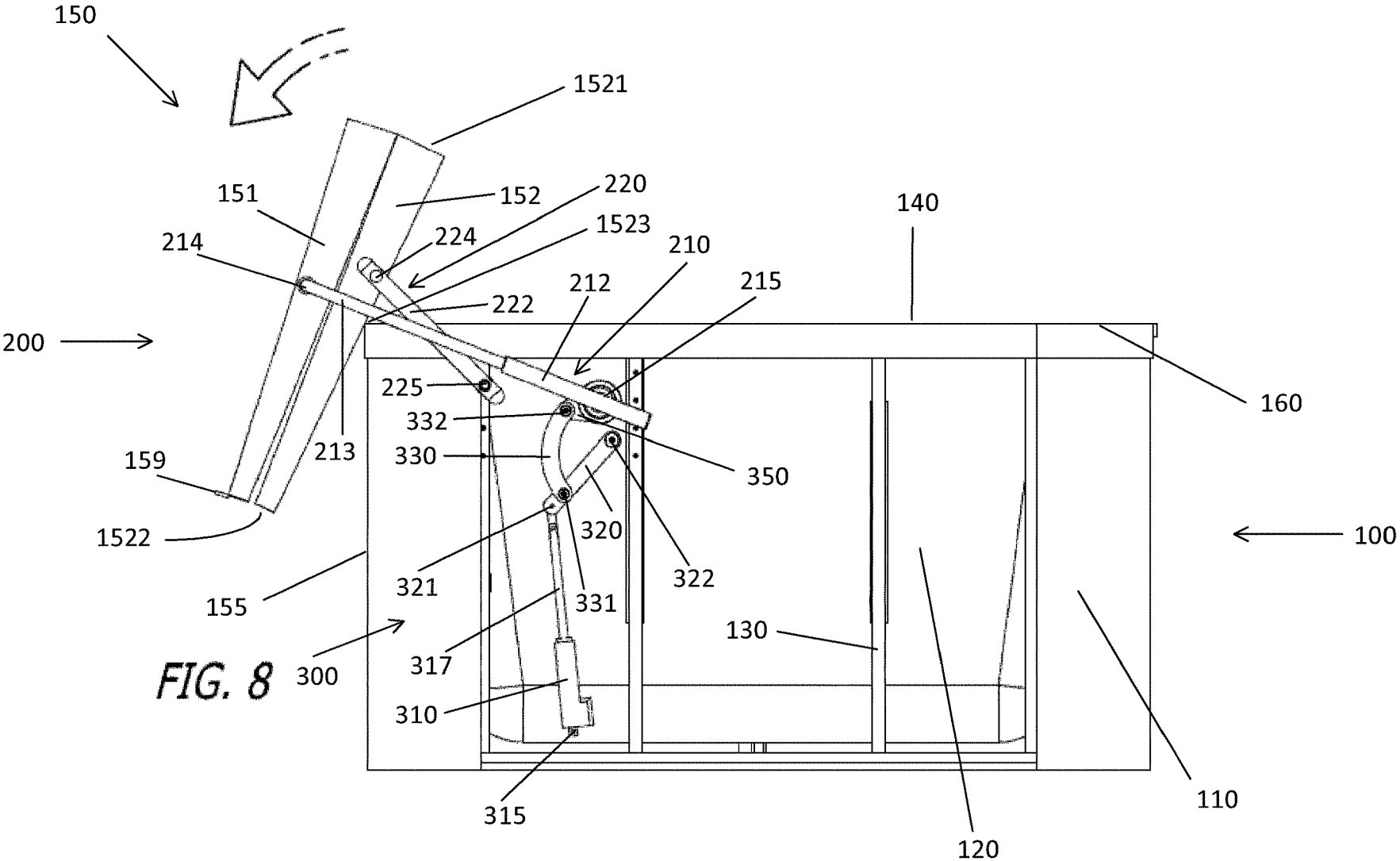
FIG. 8 is a side view of the spa pool depicted in FIG. 7.

Further rotation of the first arm 210 brings the first section 150 of the spa pool cover 150 over the edge of the rim 160 and towards the rear side 155, causing the second arm 220 and second section 152 of the spa pool cover 150 to continue to rotate in the same direction. The point 1523 at which the second section 152 of the spa pool cover 150 and the rim of the spa pool 160 contact one another moves towards the articulated edge 1521 of the second section 152 of the spa pool cover 150 as the second section 152 of the spa pool cover 150 continues to rotate, causing the first and second section 151 and 152 to fold together. This is depicted in FIGS. 7 and 8.

Figure 9:
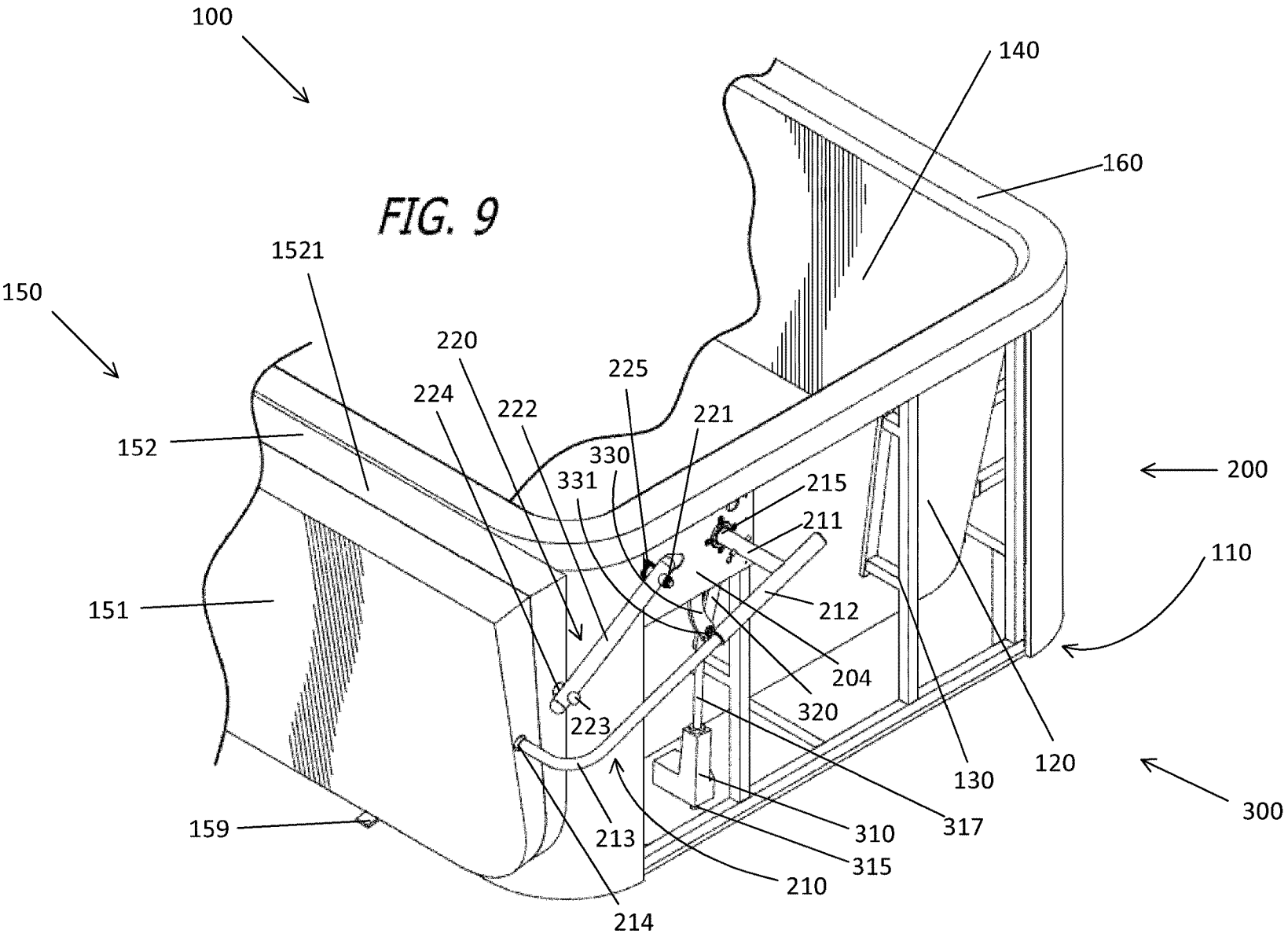
FIG. 9 is a perspective view of the spa pool shown in FIG. 1 with its cover fully removed and in a position in which the spa pool is accessible.
Figure 10:
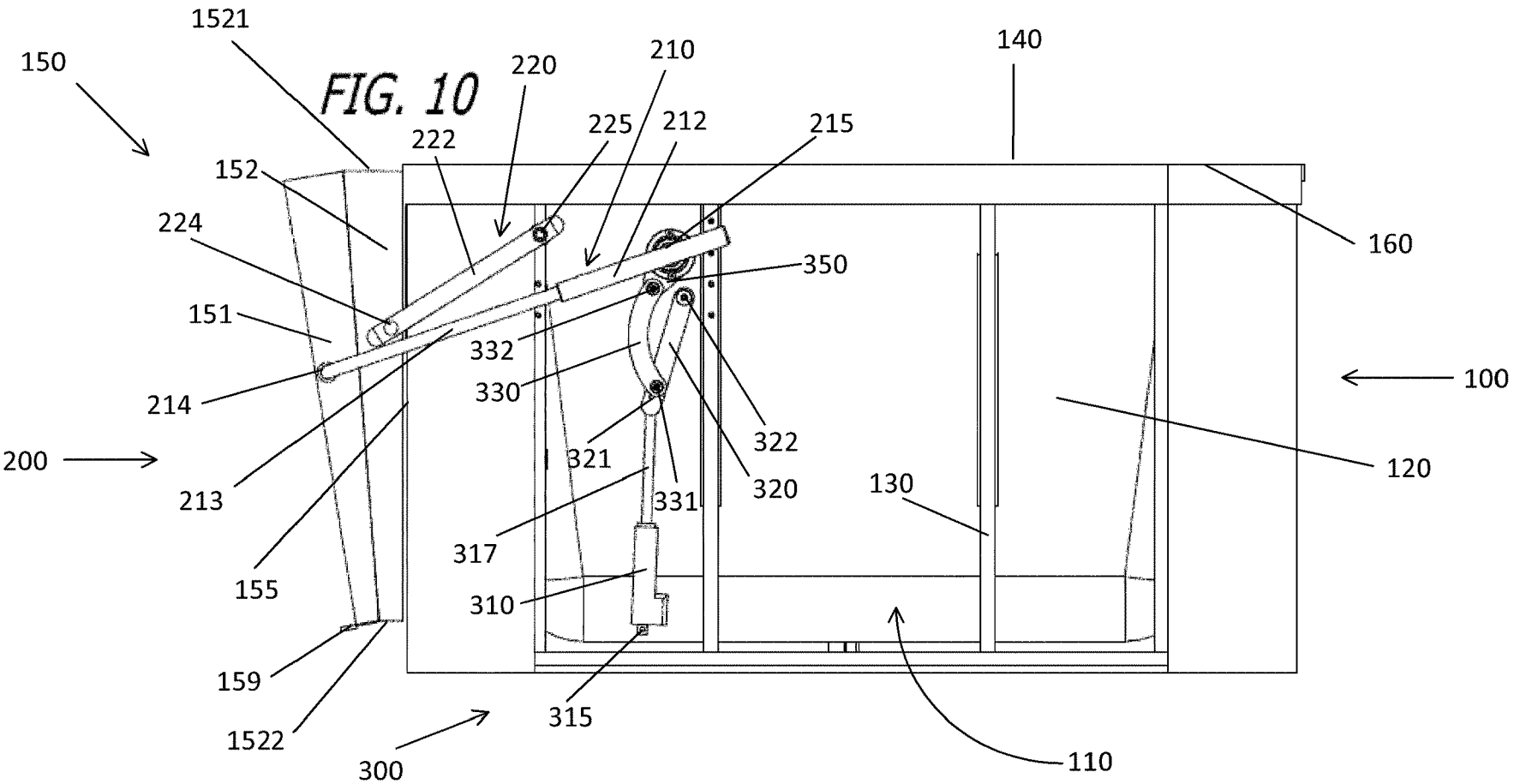
FIG. 10 is a side view of the spa pool depicted in FIG. 9.

If the first arm 210 continues to rotate, the first and second sections 151 and 152 of the spa pool cover 150 fold together until they are substantially flush with one another and the second section 152 of the spa pool cover 150 is substantially flush with the rear side of the spa pool 115. This is depicted in FIGS. 9 and 10. In this position the spa pool may be uncovered for use with the covers stowed to one side and below the edge of the spa pool.

To replace the spa pool cover 150 back into the covering position from the position in which the spa pool 100 is accessible, the first arm 210 is simply rotated in the opposite direction (which is in the clockwise direction with respect to FIG. 2) to reverse the entire process. Once the first and second sections 151 and 152 of the spa pool cover 150 are substantially flush with the rim of the spa 160 and the spa pool cover 150 is in the covering position, any straps or latches 159 can be re-secured to the side of the spa 110 until the spa pool cover 150 needs to be removed again.

In the embodiment depicted in FIGS. 2 to 10, both the first and second sections 151 and 152 of the spa pool cover 150 are completely below the top rim of the spa pool 160 when they are substantially flush with one another and with the rear side of the spa pool 115, as shown in FIG. 10. However, at least a portion of the first and/or second section 151 and 152 of the spa pool cover 150 may protrude above the rim of the spa pool 160 in other embodiments. This at least partially depends on the geometry and shape of the spa pool 100 and cover 150, and in particular the height of the top rim of the spa pool 160 compared to the size of each section 151 and 152 of the spa pool cover 150.

The spa pool cover 150 may be completely below the rim of the spa pool 160 when it is in the position in which the spa pool is accessible, as shown in FIGS. 9 and 10. In other embodiments, the spa pool cover 150 may only be substantially below the rim of the spa pool 160, or only the majority of the spa pool cover 150 may be below the rim of the spa pool 160. In still further embodiments, the spa pool cover 150 may only be partially below the rim of the spa pool 160 when it is in the position in which the spa pool 100 is accessible. The extent to which the spa pool cover 150 is below a rim of the spa pool 160 will vary according to the particular embodiment.

Moreover, the final position of the first and second sections 151 and 152 of the spa pool cover 150 may also vary in differing embodiments of the invention. For example, the first arm 210 and second arm 220 may be configured so that the first and second sections 151 and 152 of the spa pool cover 150 are not substantially flush with one another and/or with the rear side of the spa pool 115 in the uncovered position. With respect to the embodiment depicted in FIGS. 2 to 10, this could be achieved by limiting or restricting the extent to which the first and/or second arm 210 and 220 can rotate about their respective pivotal connections 215 and 225 to the sides 110 of the spa. For example, the first and second arms 210 and 220 may be configured to rotate at a maximum to the extent depicted in FIGS. 6 and 7, so that the first and second sections 151 and 152 of the spa pool cover 150 are brought to the position depicted in FIGS. 6 and 7 accordingly. In other embodiments, the first and/or second arms 210 and 220 may rotate through an arc of 150° to 180° (i.e. the extent to which they rotate may be more or less the same as the embodiment depicted in FIG. 10), but the geometry of the first and second arms 210 and 220 and their respective pivotal locations 215 and 225 to the side of the spa pool 110 and spa pool cover sections 151 and 152 may be configured to determine a different final position of the spa pool 150 cover than that depicted in FIG. 10.

The path of movement taken by the first and second section 151 and 152 of the spa pool cover 150 during rotation by the first and second arms 210 and 220 may also vary according to different embodiments. This movement is at least partially determined by the geometry and configuration of the first and second arms 210 and 220, the position of their pivotal locations 215 and 225 to the side of the spa, the location of the pivotal connections to the first and second section 151 and 152 of the spa pool cover 150, and the geometry of the articulated spa cover 150.

These all may vary according to different embodiments and their applications. For example, the first and second arms 210 and 220 may be configured so that the second section 152 of the spa pool cover 150 does not contact the edge of the rim 160 during removal of the spa cover 150 from the covering position.

Furthermore, it should be noted that although the operation of the spa pool cover lifter 200 has been described with respect to a spa pool lifter 200 having a first and second arm 210 and 220, the general principles outlined above equally apply to embodiments which include a third and/or fourth arm 230 and 240. In these embodiments, the third and first arms 230 and 210 perform substantially the same function as one another, as do the fourth and second arms 240 and 220. Both pairs of arms are configured so that when the first and third 210 and 230 arms are rotated, the first and second sections 151 and 152 of the spa pool cover 150 fold together and move from a position covering the top 140 of the spa pool 100 to a position in which the spa pool is accessible (and vice versa), as described above.

Actuation

Manual operation of the spa pool cover lifter 200 is possible by a user manually rotating the first arm 210 in either direction, and some embodiments of the first arm 210 may include a protruding handle or other ergonomic feature to assist a user rotating the arm. Some embodiments may also include a driven assembly to drive the rotation of the first arm 210 about its pivotal axis 215 to the side of the spa pool 110, without the user needing to expend substantial manual effort.

In some embodiments, the spa pool cover lifter 200 may include an actuator 310 configured to actuate the rotation of the first arm 210 about its pivotal connection 215 to the side 110 of the spa pool. For example, the actuator 310 may be a rotary actuator, such as a motor which may include a rotating drive shaft. The first arm 210 of the spa cover lifter 200 may be coupled to the drive shaft through a transmission or the like to convert the rotational motion of the drive shaft to rotational motion of the first arm 210 about its pivotal connection 215 to the side 110 of the spa pool.

In other embodiments, the actuator 310 may be a linear actuator, such as an electrical linear actuator or a hydraulic cylinder. A mechanical linkage 300 may be provided between the actuator 310 and the first arm 210 to convert at least a portion of the linear translation of the linear actuator 310 to rotation of the first arm 210 about its pivotal connection 215 to the side 110 of the spa pool. In some embodiments, the first arm 210 may be connected to an eccentric drive plate 350 which is coupled in turn to the mechanical linkage 300. The mechanical linkage 300 may further comprise an over-rotation linkage between the linear actuator 310 and the eccentric drive plate 350 to which the first arm 210 is connected or coupled to. The mechanical linkage and/or over-rotation linkage may be configured to allow the first arm to rotate through an arc of between 150° to 180°, or even further in other embodiments.

An example embodiment of a mechanical linkage 300 is depicted in FIGS. 2 to 10. With respect to FIG. 2, the spa pool cover lifter 200 includes a linear actuator 310. In this embodiment, the linear actuator 310 includes a pivotal connection 315 at its base to the frame 130 of the spa pool. This pivotal connection 315 allows the linear actuator 310 itself to rotate relative to the frame 130 of the spa pool as the linear actuator 310 actuates the rotation of the first arm 210. This pivotal connection 315 may be absent in other embodiments which include different mechanical linkages 300 between the linear actuator 310 and the first arm 210.

The linear actuator 310 includes a drive rod 317 which can extend and/or retract to effect the rotation of the first arm 210 about its pivotal connection 215 to the side 110 of the spa pool. The drive rod 317 is rotatably connected to a first plate 320 of the mechanical linkage 300 at a first rotatable connection 321.

The first plate 320 is substantially straight in the embodiment of the mechanical linkage 300 depicted in FIGS. 2 to 10, although it may be curved to various extents in other embodiments. The first plate 320 is also rotatably connected to the side 110 of the spa pool about a second rotatable connection 322, which may be situated in mounting plate 204.

The mechanical linkage 300 further includes a second plate 330 which is rotatably connected to the first plate 320 about a third rotatable connection 331 at one of its ends. The second plate 330 has a curved shape in the embodiment depicted in FIGS. 2 to 10, although other embodiments may include second plates 330 which have a different shape. The other end of the second plate 330 is rotatably connected to an eccentric drive plate 350 about a fourth rotatable connection 332. The eccentric drive plate 350 is connected to the first arm 210 and is rotatably connected to the side 110 of the spa pool.

The mechanical linkage 300 of the embodiment depicted in FIGS. 2 to 10 is configured so that the drive rod 317 is extended when the spa pool cover 150 is in the covering position. To remove the spa cover 150 from the spa pool 100, the drive rod 317 of the linear actuator 310 is progressively retracted and rotates the first arm 210 counter-clockwise to uncover the spa pool 100 as depicted in FIGS. 2 to 10. The linear translation of the drive rod 317 causes the first plate 320 to rotate in the counter-clockwise direction about its second pivotal connection 322 to the side 110 of the spa pool. The second plate 330 follows the rotation of the first plate 320 due to the third rotatable connection 331 between the two, and this in turn causes the eccentric drive plate 350 (and hence the first arm 210) to rotate in suit. The pivotal connection 321 between the drive rod 317 of the linear actuator 310 and the first plate 320 also allows the linear actuator 310 to rotate about its pivotal connection 315 to the side 110 of the spa pool while the first plate 320 progressively rotates about its connection 321 to the side of the spa pool.

Because the respective connections 331 and 332 between the second plate 330 and the first plate 320 and the eccentric drive plate 350 are rotatable, the angle between the eccentric drive plate 350 and first plate 320 changes as the first plate 320 rotates from its initial position to its final position in which the spa pool cover 150 has been removed. This allows the first and second plates 320 and 330 to act as an "over-rotation linkage" between the linear actuator 310 and the eccentric drive plate 350, enabling the actuator 310 to rotate the first arm 210 through an angle between 150° to 180°, or even further in other embodiments.

For example, when the spa pool 100 is covered as depicted in FIG. 2, a line drawn from the fourth rotatable connection 332 (between the second plate 330 and the eccentric drive plate 350) to the connection between the eccentric drive plate 350 and the first arm 210 meets the longitudinal axis of the first plate 320 at an angle of approximately 90°. This angle continues to decrease as the eccentric plate 350 rotates and becomes more aligned with the longitudinal axis of the first plate 320 during the removal of the spa cover 150. In the final position depicted in FIG. 10, in which the spa cover 150 has been removed and the spa pool 100 is accessible, the same line intersects the longitudinal axis of the first plate 320 at an angle of approximately 10°. As the mechanical linkage 300 depicted in FIGS. 2 to 10 is a non-limiting embodiment, these values may vary accordingly in other embodiments depending how they are configured and their application.

During the removal of the spa pool cover 150, the drive rod 317 of the linear actuator 310 is retracted until the first and second arms 210 and 220 have rotated and caused the first and second sections 151 and 152 of the spa pool cover 150 to fold together and move to a position in which the spa pool is accessible, as depicted in FIG. 10. When the spa pool cover 150 is to be replaced in the covering position, the drive rod 317 of the linear actuator 310 is extended to rotate the first plate 320 in the clockwise direction until it has reached the original position depicted in FIG. 2, and the process depicted in FIGS. 2 to 10 substantially takes place in reverse.

Various components of the mechanical linkage 300 may be configured differently in other embodiments. For example, the mechanical linkage 300 may be configured so that extension (rather than retraction) of the drive rod 317 rotates the first arm 210 to remove the cover from the spa. The positions and geometries of the different rotatable connections may also vary depending on the embodiment.

Furthermore, it should be noted that in the embodiment depicted in FIGS. 2 to 10, the mechanical linkage 300 is supported by a mounting plate 204 (shown in FIGS. 1A and 1B) which in turn is supported by the frame 130 of the spa. For example, the first plate 320 may be connected to the mounting plate 204 at the second rotatable connection 322, and the eccentric drive plate 350 may be connected to the mounting plate at the fourth rotatable connection 332. However, the mounting plate 204 has been hidden in FIGS. 2, 4, 6, 8, and 10 in order to clearly show the operation of the depicted embodiment of the linear actuator 310 and mechanical linkage 300.

Moreover, although the actuator 310 and mechanical linkage 300 have only been described with reference to the first and second arm 210 and 220, the same description and principles of operation apply to embodiments of the spa pool cover lifter 200 which include a third and fourth arm 230 and 240. For example, the third arm 230 may also be driven to effect its rotation about its pivotal connection 235 to the side 110 of the spa pool. In these embodiments, mechanical linkages 300 may be provided between each linear actuator 310 and respective first or third arm 210 and/or 230. Each mechanical linkage 300 may convert the linear translation of the respective linear actuator 310 to rotation of the first and/or third arm 210 and/or 230 about its pivotal connection 215 and/or 235. The mechanical linkage 300 may comprise an eccentric drive plate 350 connected to the first and/or third arm 210 and/or 230.

In still further embodiments, different mechanical linkages 300 may be used to rotate the first and/or third arm 210 and/or 230 using a linear actuator 310. As a non-limiting example, the mechanical linkage 300 may be a rack and pinion, a slide and crank, or a treadle linkage. The mechanical linkage 300 may vary depending on the application of the spa cover lifter.

Controller

In some embodiments where an actuator 310 is included, the spa pool cover lifter 200 may further comprise a controller 400 (as depicted in FIG. 2) configured to operate and control the actuator 310 to effect rotation of the first and/or third arm 210 and/or 230. The controller 400 may also include a user interface 410 which is in operative communication with the controller 400 to enable a user to operate the actuator 310 via the controller 400.

For example, in some embodiments, the user interface 410 may be a button or may be a cylinder configured to receive a key. Pressing the button or turning the key within the cylinder may cause the controller 400 to engage the actuator 310 to remove or replace the spa pool cover 150 via rotation of the arms of the spa pool cover lifter 200.

In still further embodiments, the controller 400 may include a receiving module 430 configured to receive a wireless signal. This can allow a user to wirelessly operate the actuator 310 via the controller 400 of the spa pool cover lifter 200 using an associated wireless sender (here shown in a non-limiting way as part of the user interface 410.) The receiving module 430 may be compatible with standard wireless protocols including Bluetooth, Zigbee, and/or Wi-Fi or IEEE 802.11 standards. The user interface 410 may also be in operative communication with the controller 400 via the receiving module 420.

In some embodiments, the user interface 410 may be configured as a 'live man switch' or an enabling device as a safety feature. In other words, the controller 400 will interrupt the actuator and/or prevent its operation unless the user interface 410 is actively engaged by the operator (e.g. unless the button is continually pressed or the key within the cylinder is held in a rotated position.) This functionality may reduce the possibility of the actuator 310 replacing the cover 150 of the spa pool 100 while someone is inside the spa pool 100, as a user cannot start the cover replacement process and consequently climb into the spa before the cover is in place. In some embodiments, the live man switch functionality may be required to replace the spa pool cover 150 on the spa pool 100, but not be required to uncover the spa pool 100.

The spa pool 100 may also include an additional emergency user interface within the vicinity of the tub 120 of the spa pool 100. For example, the emergency user interface may be an emergency button within the interior of the spa pool 100 and in communicative operation with the controller 400. If the spa pool cover 150 is somehow replaced while a person is within the spa pool 100, they can engage the actuator 310 to remove the spa pool cover 150 and to allow them to leave the interior of the spa pool 100.

As an additional safety feature, the controller 400 may be configured to prevent or interrupt operation of the actuator 310 if an obstruction is detected either before or during its operation. This may prevent damage to the spa pool cover 150 or spa pool cover lifter 200 or accidental harm to users or other people nearby the spa pool 100. In some embodiments, the controller 400 may be configured to detect whether an obstruction is present by monitoring the torque or force transmitted by the actuator. For example, this could be achieved by monitoring the current supplied to the linear actuator by its power supply. In other embodiments, the force or torque could be measured directly by a torque or force sensor at the output of the actuator.

Although the controller is only depicted in FIG. 2, it is also present in the embodiments depicted in FIGS. 3 to 10 but is omitted for brevity.

Independent Spa Pool Cover Lifter

Although the depicted embodiments of the spa pool cover lifter 200 are supported by the frame 130 or sides 110 of a spa pool 100, other embodiments may include a stand-alone spa pool cover lifter 200 which may not be integrated with the spa pool 100. For example, if the spa pool 100 is kept at least partially indoors, the spa pool cover lifter 200 may be pivotally connected to the walls which surround the spa pool 100. In alternative embodiments, the spa pool cover lifter 200 may be pivotally connected to plinths or columns which are spaced apart from the spa pool 100 itself. In still further embodiments, the spa pool cover lifter 200 could be sold or installed as a retrofit kit to be used with existing spas.

In these embodiments, the structure and components of the spa cover lifter 200 will be substantially the same and will include a first and second arm 210 and 220. The first and second arms 210 and 220 are rotatable about a mount at their proximal ends 211 and 221 and are rotatably connected to the first and second sections 151 and 152, respectively, of the spa pool cover 150 at their distal ends 214 and 224. The rotation and operation of the first and second arms 210 and 220 is substantially the same as described above. The spa pool cover lifter 200 may also include third and fourth arms 230 and 240. Actuators 310 and mechanical linkages 300 may be included to effect the rotation of the first and/or third arms 210 and/or 230 about their respective mounts 211 and 231. A mechanical linkage 300 may be included between each of the respective actuators 310 and the first and/or third arms 210 and 230. The details of the mechanical linkage may be substantially the same as described above.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A cover lifter assembly for a spa, the cover lifter assembly comprising:

a spa cover comprising a first section and a second section;

a cover lifter comprising, a first arm rotatable about a first pivotal connection to a side of the spa and pivotally connected to the first section of the spa cover;

a second arm rotatable about a second pivotal connection to a side of the spa and pivotally connected to the second section of the spa cover;

wherein the arms are configured such that, when the cover lifter assembly is installed on the spa, rotation of the first arm about the first pivotal connection causes the first and second sections of the spa cover to fold together and rise from a top of the spa to move from a position covering the top of the spa to a position in which the spa is accessible;

wherein during operation of the cover lifter assembly, the second arm remains within a clearance between the first arm and the side of the spa.

2. The cover lifter assembly of claim 1, further comprising at least one actuator configured to actuate the rotation of the first arm about its pivotal connection to the side of the spa-pool.

3. The cover lifter assembly of claim 2, wherein the at least one actuator is a linear actuator.

4. The spa pool cover lifter assembly of claim 2, further comprising a controller configured to operate and control the at least one actuator.

5. The cover lifter assembly of claim 2, wherein a mechanical linkage is provided between the at least one actuator and the first arm.

6. The cover lifter assembly of claim 5, wherein the mechanical linkage converts linear translation of the at least one actuator to rotation of the first arm about its pivotal connection to the side of the spa.

7. The cover lifter assembly of claim 6, wherein the mechanical linkage comprises an eccentric drive plate connected to the first arm.

8. The cover lifter assembly of claim 7, wherein the mechanical linkage comprises an over-rotation linkage between the at least one actuator and the eccentric drive plate.

9. The cover lifter assembly of claim 8, wherein the over-rotation linkage allows rotation of the first arm through between 150 to 180 degrees of movement.

10. The cover lifter assembly of claim 8, wherein each over-rotation linkage comprises:

a first plate rotatably connected to a side of the spa pool about a first rotatable connection and a linear actuator about a second rotatable connection; and a second plate rotatably connected to the eccentric drive plate about a third rotatable connection and the first plate about a fourth rotatable connection.

11. A cover lifter assembly for a spa, the cover lifter assembly comprising:

a spa cover comprising a first section and a second section;

a cover lifter comprising, a first arm rotatable about a mount for connection to a side of a spa at its proximal end and pivotally connectable to the first section of the spa cover at its distal end;

a second arm rotatable about a mount for connection to a side of the spa at its proximal end and pivotally connectable to the second section of the spa cover at its distal end;

an actuator configured to actuate the rotation of the first arm about its mount at its proximal end; and a controller configured to operate and control the actuator to effect rotation of the first arm;

wherein the arms are configured such that, in use, the rotation of the first arm about its mount causes the first and second sections of the spa cover to fold together and rise from a top of the spa to move from a closed position covering the top of the spa pool to an open position in which the spa is accessible;

wherein the controller prevents operation of the actuator unless a user interface is actively engaged;

wherein, when the cover lifter assembly is installed on the spa and the arms are in the open position, a lower surface of the second section is configured to face a rear side of the spa; and wherein, when the cover lifter assembly is installed on the spa and the arms are in the closed position, the lower surface of the second section is configured to face an interior of the spa.

12. The cover lifter assembly of claim 11, wherein the actuator is a linear actuator.

13. The cover lifter assembly of claim 11, wherein the user interface is a button.

14. The cover lifter assembly of claim 11, wherein the user interface is a cylinder configured to receive a key.

15. The cover lifter assembly of claim 11, wherein a mechanical linkage is provided between the actuator and the first arm.

16. The cover lifter assembly of claim 15, wherein the mechanical linkage converts linear translation of the actuator to rotation of the first arm about its mount.

17. The cover lifter assembly of claim 16, wherein the mechanical linkage comprises an eccentric drive plate connected to the first arm.

18. The cover lifter assembly of claim 17, wherein the mechanical linkage comprises an over-rotation linkage between the actuator and the eccentric drive plate.

19. The cover lifter assembly of claim 18, wherein the over-rotation linkage allows rotation of the first arm through between 150 to 180 degrees of movement.

20. The cover lifter assembly of claim 18 wherein the over-rotation linkage comprises:

a first plate rotatably connected to a frame about a first rotatable connection and the actuator about a second rotatable connection; and a second plate rotatably connected to the eccentric drive plate about a third rotatable connection and the first plate about a fourth rotatable connection.

* * * * *